United States Patent [19]

Maruyama

[11] 4,284,615

[45] Aug. 18, 1981

[54] PROCESS FOR THE PRODUCTION OF CARBON FIBERS

[75] Inventor: Kunio Maruyama, Okayama, Japan

[73] Assignees: Japan Exlan Company, Ltd.; Sumitomo Chemical Company Limited, both of Osaka, Japan

[21] Appl. No.: 127,980

[22] Filed: Mar. 6, 1980

[30] Foreign Application Priority Data

Mar. 8, 1979 [JP] Japan ..... 54-27436

[51] Int. Cl.[3] ..... D01F 9/12; D01F 9/16; D01F 9/22

[52] U.S. Cl. ..... 423/447.4; 423/447.1; 423/447.6; 264/29.2

[58] Field of Search ..... 423/447.4, 447.6, 447.1, 423/447.2; 264/29.2

[56] References Cited

U.S. PATENT DOCUMENTS

| | | | |
|---|---|---|---|
| 3,817,700 | 6/1974 | Menikheim | 423/447.4 |
| 3,933,986 | 1/1976 | Matsumura et al. | 423/447.4 |

*Primary Examiner*—Edward J. Meros

*Attorney, Agent, or Firm*—Wenderoth, Lind & Ponack

[57] ABSTRACT

A process is provided for producing carbon fibers characterized by fixing a specified amount of a chemical substance onto thermally stabilized fibers and/or carbonized fibers to impart good collectivity and then carbonizing and/or graphitizing the fibers, said chemical substance selected from one or more of the compounds of glycerin, polyethylene glycol, polypropylene glycol and alkyl derivatives thereof.

5 Claims, No Drawings

PROCESS FOR THE PRODUCTION OF CARBON FIBERS

BACKGROUND OF THE INVENTION

The present invention relates to a process for the production of carbon fibers wherein a prescribed amount of a particular chemical substance is fixed onto thermally stabilized fibers and/or carbonized fibers to give the fibers good filaments collectivity, and thereafter the fibers are carbonized and/or graphitized, whereby the handling of these fibers is made easy and at the same time high quality carbon fibers (including graphitized fibers; this shall apply hereinafter) can be produced.

DESCRIPTION OF THE PRIOR ART

Upon producing carbonized fibers from thermally stabilized fibers or upon producing graphitized fibers from carbonized fibers, it has been a problem heretofore that various troubles (difficulties in handling) such as fuzz generation of the starting fibers, their entanglement around guides, rollers, etc. are caused in the production process of these fibers, resulting in not only a decrease in productivity but also a deterioration of the quality of the carbon fibers are caused. To remedy such difficulties in handling, various proposal have been made, but it is no exaggeration to say that none of them have been successful. For example, a method in which thermally stabilized fibers are given twists and then carbonized, as described in Laid-Open (Kokai) Japanese patent application Nos. 41040/1973 and 105419/1976; a method in which carbonized fibers are sized with a thermo-setting resin (for example an epoxy resin), as described in Laid-Open (Kokai) Japanese patent application Nos. 29529/1975; etc. have been proposed. However, in the former method of giving twists, there is a fatal defect in that the thermal stabilization operation and the carbonization operation cannot be carried out continuously. (If one attempts to carry out a continuous operation, a complicated apparatus is necessary and in addition it is inevitable that troubles such as fuzz generation and fiber entanglement will occur frequently.) In the latter method of epoxy resin sizing, single filaments adhere to one another in the subsequent graphitizing operation or surface treatment operation, because of the resin used. This results in a disadvantage that fuzz is also generated in the processing steps of prepreg formation and filament winding. Another method is proposed wherein precursor fibers given twists beforehand are heated, as described in Laid-Open (Kokai) Japanese patent application No. 87824/1974. However, in this method, if the thickness of the fiber bundle exceeds 10,000 deniers, internal heat accumulation occurs in the central portion of the fiber bundle, and the gas generated by heating cannot diffuse away sufficiently. Therefore, satisfactory carbon fibers cannot be finally obtained.

SUMMARY OF THE INVENTION

In such a situation, I, the inventor, studied on a possible method which will facilitate the handling in the production process of carbon fibers and by which carbon fibers having excellent physical properties can be produced at high productivity. As a result, I found that, before thermally stabilized fibers or carbonized fibers are brought to the next process step, when a particular chemical substance is fixed onto said fibers to give good filaments collectivity, all the difficulties accompanied with the conventional techniques can be removed. This discovery led to the present invention.

The main object of the present invention is to provide a method by which the handling of thermally stabilized fibers is made easy and high quality carbon fibers are produced efficiently.

Another object of the present invention is to provide a method which eliminates such troubles as the fuzz generation, spreading, filament breakage of the heat-treated fibers and which can produce fusion-free carbon fibers having a high tensile strength and a high modulus of elasticity in a short time of heat-treatment.

Other objects of the present invention will become apparent from the following concreate explanation of the invention.

DETAILED DESCRIPTION OF THE INVENTION

Such objects of the present invention can be attained by fixing 0.1–5 weight % of glycerin, polyethylene glycol, polypropylene glycol, or an alkyl derivative thereof, or a mixture or a compound of two or more of these chemical substances onto thermally stabilized fibers and/or carbonized fibers to give the fibers good collectivity, and thereafter carbonizing and/or graphitizing the fibers.

By fixing such a particular chemical substance onto the heat-treated fibers, favorable filaments collectivity is given to the fibers being treated in the process steps of carbonization, graphitization, and dry-method surface oxidation treatment. Therefore, troubles which injure the handling properties, such as fuzz generation, spreading, entanglement, etc. of the fibers being treated, caused by a number of accessory appliances such as comb-like guides, fixed bars, rollers, etc. are greatly reduced and finally carbon fibers satisfying the improvement of appearance and elevation in quality can be produced. Furthermore, since the above-mentioned chemical substances evaporate and disappear substantially in the course of heat-treatment, there is no anxiety that they will change into pitch-like or tar-like substances which deposits on the surface of the carbonized fibers or graphitized fibers.

The expression "thermally stabilized fibers" used in the present invention is a generic term for fibers produced from the usual precursors for carbon fibers such as polyacrylonitrile fibers, cellulosic fibers, polyvinyl alcohol fibers, etc. by heating them in an oxidizing atmosphere at 200°–400° C. The term "carbonized fibers" means fibers produced from such thermally stabilized fibers by carbonizing them in a non-oxidizing atmosphere at 800°–1500° C. The term "graphitized fibers" means fibers produced from such carbonized fibers by heat-treating them in a non-oxidizing atmosphere at 2000°–3000° C., or by passing an electric current directly through such carbonized fibers. In every case, there is no particular limitation on the operations of thermal stabilization, carbonization, and graphitization, and the usual methods are employed.

The chemical substances which can give good collectivity of fibers to such thermally stabilized fibers and carbonized fibers are selected from the group consisting of glycerin, polyethylene glycol, polypropylene glycol, alkyl derivatives thereof, and mixtures and compounds of two or more of these chemcial substances. As such alkyl derivatives, there may be mentioned ether compounds thereof with methyl alcohol, ethyl alcohol, butyl alcohol, propyl alcohol, pentanol, hexanol, etc., or ester compounds thereof with carboxylic acids or oxycarboxylic acids such as formic acid, acetic acid, oxalic acid, malonic acid, succinic acid, butyric acid, lactic acid, malic acid, etc. The "mixtures" are mere mixtures of the above-mentioned substances in a voluntary ratio, and the "compounds" are, for example, ether of glycerin with polyethylene glycol or polypropylene glycol; block-copolymer or random copolymer of polyethylene glycol with polypropylene glycol; etc.

Among the above-mentioned chemical substances, those satisfying the following points promote the attainment of the objects and effects of the present invention:

(a) those leaving a residue less than 5 weight % after being subjected to a heat treatment at 240° C. for one hour. (The results of residue tests (240° C.×1 hour) for the chemical substances of the present invention and the usual spinning oils are shown in Table 1.)

TABLE 1

| | Substances tested | Amount of decomposed residue left (%) |
|---|---|---|
| A | Polyethylene glycol (400) lauric acid ester | 40–50 |
| B | Sodium sulfosuccinic acid diisooctyl ester | 40–50 |
| C | Mixture of sorbitan monolaurate ethylene oxide addition product and polyethylene glycol oleic acid ester (50/50) | 60 |
| D | Block copolymer of polyethylene glycol (1000) and polypropylene glycol (2000) | 0.7 |
| E | Glycerin | 0 |
| F | Polypropylene glycol (1000) | 0.1 |
| G | Polyethylene glycol (1000) | 2.0 |
| H | Polyethylene glycol (4000) | 1.6 |
| I | Polypropylene glycol (4000) | 0.5 |

In the above residue tests, 10 grams of the substances to be tested was put into a flat dish made of aluminum, 8.5 cm in diameter and 1.0 cm in depth, and was heated for one hour in a hot air current dryer at 240° C. at an air current speed of 2 m/sec. Then the weight of the residue (X grams) was measured accurately. The amount of the decomposition residue was evaluated from the following formula:

$$\text{Amount of the decomposition residue } (\%) = (X/10) \times 100$$

To obtain best results, (b) those satisfying the item (a) and having a room temperature viscosity not less than 50 centipoises, preferably not less than 100 centipoises, and which are in the form of liquid or waxy solid. (Substances having a lower viscosity require a large amount above 5% to be fixed, in order that they can give proper collectivity of fibers, and therefore such substances are not desirable to use.)

As concrete examples of the chemical substances satisfying the items (a) and (b) simultaneously, there may be mentioned polyethylene glycol (molecular weight 400–10,000), polypropylene glycol (m. w. 600–20,000), copolymer of polyethylene glycol and polypropylene glycol (m. w. 1000–20,000) and glycerin. The use of these substances makes it possible to improve the handling properties of the fibers during the steps of heat treatments and to produce high quality carbon fibers.

As regards such substances, it is necessary to add 0.1 to 5 weight %, based on the weight of the fibers, to thermally stabilized fibers or carbonized fibers. If the amount is less than 0.1%, the objects of the present invention cannot be attained advantageously. If the amount exceeds 5%, the fibers become sticky, or the carbonizing furnace, graphitizing furnace, rollers, guides, etc. are soiled. Therefore, the use of such amounts is not desirable.

In order that said particular substances should be fixed onto thermally stabilized fibers or carbonized fibers, the following methods may be employed: A method wherein said substance itself is sprayed onto said fibers, or a solution of said substance dissolved in water, alcohol, carbon tetrachloride, etc. it sprayed onto said fibers; a method wherein the fibers are immersed into said solution; a method wherein said fibers are put into contact with a roller which carries said solution on its surface; etc.

For a better understanding of the present invention, representative examples are shown in the following. In the examples, percentages and parts are shown by weight unless otherwise indicated.

EXAMPLE 1

Acrylic fibers (44,000 filaments/66,000 deniers) containing, chemically combined therewith, 98% acrylonitrile were continuously thermally stabilized in a hot air circulating thermal stabilization furnace at 240° C. for 60 minutes. After the thermally stabilized fibers were immersed in a 0.2–5% aqueous solution or dispersion of the substances shown in Table 2 (the treating substances A–H are the same as those shown in Table 1), the fibers were squeezed with pressure rollers, and thereafter the fibers were continuously carbonized in a nitrogen current at 200°–800° C. for 2 minutes and at 800°–1300° C. for one minute. The state of fiber entanglement and the state of filament breakage in the step of producing such carbonized fibers were examined. The results are shown together in Table 2. The mechanical properties of the carbonized fibers thus obtained are also shown in Table 2.

TABLE 2

| Treating substance | Amount added (%) | Fiber entanglement | Filament* breakage | Modulus of elasticity (ton/mm$^2$) | Tensile strength (kg/mm$^2$) |
|---|---|---|---|---|---|
| A | 2.7 | little | medium | 22.7 | 209 |
| B | 1.9 | " | much | 21.4 | 151 |
| C | 3.2 | " | " | 21.1 | 164 |
| D | 2.5 | very little | very little | 24.8 | 302 |
| E | 0.05 | much | much | 23.6 | 245 |
| E | 0.15 | medium | medium | 23.7 | 262 |
| E | 0.5 | little | little | 24.1 | 276 |
| E | 0.8 | very little | very little | 24.6 | 285 |
| E | 1.0 | very little | very little | 24.8 | 290 |
| E | 2.3 | very little | very little | 24.3 | 275 |
| E | 4.2 | very little | very little | 24.2 | 274 |
| E | 5.5 | medium | little | 23.8 | 252 |
| F | 1.5 | very little | very little | 24.7 | 298 |
| G | 1.2 | very little | very little | 24.8 | 297 |
| H | 0.05 | much | much | 22.8 | 220 |
| H | 2.5 | very little | very little | 24.6 | 288 |
| H | 5.5 | medium | much | 22.9 | 234 |
| No treat- | — | medium-much | medium | 24.3 | 258 |

TABLE 2-continued

| Treating substance | Amount added (%) | Fiber entanglement | Filament* breakage | Modulus of elasticity (ton/mm$^2$) | Tensile strength (kg/mm$^2$) |
|---|---|---|---|---|---|
| ment | | | | | |

*The fibers were wound around a steel wire having a diameter of 0.5 mm and the breaking behavior was observed.

EXAMPLE 2

Acrylic filaments (12,000 filaments/16,000 deniers) produced from a copolymer consisting of 97.5% acrylonitrile and 2.5% methacrylic acid were stretched 20% in length in a tubular furnace at 180° C., and thereafter the filaments were thermally stabilized continuously at 240° C. for 90 minutes. The thermally stabilized filaments were immersed in an aqueous solution of polyethylene glycol (2000) so that 1.5%, based on the weight of the filaments, of the polyethylene glycol could be fixed onto the filaments. Thereafter, the filaments were carbonized by the same operation as in Example 1. The fuzz generation in the step of carbonization and the mechanical properties of the carbonized filaments are shown in Table 3.

TABLE 3

| | Fuzz generation in the step of carbonization | Amount of filaments entangled around the rollers (g/1000 m) | Modulus of elasticity (ton/mm$^2$) | Tensile strength (kg/mm$^2$) |
|---|---|---|---|---|
| Treated | Substantially no | 0.03 | 24.2 | 381 |
| Non-treated | Fluff generated | 1.3 | 23.9 | 285 |

EXAMPLE 3

The same thermally stabilized fibers as used in Example 2 were immersed in a toluene solution of polypropylene glycol (4000) so that 1.2%, based on the weight of the fibers, of the polypropylene glycol could be fixed onto the fibers. The fibers were then removed from toluene by a hot air current at 130° C. Thereafter, the fibers were carbonized by the same operation as in Example 1. There was neither fuzz generation nor fiber entanglement around the rollers in the carbonizing step. Moreover, the mechanical properties of the carbonized fibers were excellent: the Young's modulus was 24.0 ton/mm$^2$, and the tensile strength was 415 kg/mm$^2$.

EXAMPLE 4

Polypropylene glycol (4000) was again fixed onto the carbonized fibers obtained in Example 3, in an amount of 1.6% based on the carbonized fibers. Thereafter, the carbonized fibers were surface-treated in a nitrogen atmosphere containing 0.2 weight % oxygen, at 900° C. for 2 minutes. For comparison, after the carbon fibers obtained as the comparative example (non-treated) in Example 2 were immersed in a toluene solution of Epicote 828, the fibers were dried at 130° C., and then surface-treated in the same way. The mechanical properties after the surface treatment of the two kinds of the fibers are shown in Table 4.

TABLE 4

| | Tensile strength (kg/mm$^2$) | ILSS* (kg/cm$^2$) |
|---|---|---|
| Invention | 357 | 8.5 |
| Comparative example | 259 | 7.0 |

*Method of measuring ILSS In the usual way, a prepreg was made, using a resin composed of 100 parts of Epicote 828 and 5 parts of $BF_3MEA$, as the matrix. The prepreg was laminated, pressed and cured to produce a composite, 3 mm in thickness, 6 mm in width and 100 mm in length, having a volume content of 60%. The composite was cut with a diamond cutter to prepare five test pieces having a length of 19 mm. The measurement was made by means of an Instron 1130 tester, according to the short beam method, with a span distance of 15 mm and a deformation speed of 1 mm/mim.

COMPARATIVE EXAMPLE 1

After the acrylic fibers used in Example 1 were given twists in the ratio of 10 t/m, it was attempted to thermally stabilize the fibers. But serious fragility and fusion occurred in the central portion of the fiber bundle, and the fiber bundle broke in the furnace. Therefore, continuous production was difficult.

What I claim is:

1. An improved process for the production of carbon fibers characterized by fixing 0.1–5 weight % of a chemical substance selected from the group consisting of glycerin, polyethylene glycol, polypropylene glycol, and alkyl derivatives thereof, and mixtures or compounds of two or more of these chemical substances onto thermally stabilized carbon precursor fibers and/or carbonized fibers to give the fibers good collectivity, and carbonizing the thermally stabilized fibers and/or graphitizing the fibers, said alkyl derivatives being selected from ether compounds obtained by reacting said chemical substances with an alcohol selected from the group consisting of methyl alcohol, ethyl alcohol, propyl alcohol, butyl alcohol, pentanol and hexanol or ester compounds obtained by reacting said chemical substances with an organic acid selected for the group consisting of formic acid, acetic acid, oxalic acid, malonic acid, succinic acid, butyric acid, lactic acid and malic acid.

2. A process as claimed in claim 1 wherein the thermally stabilized fibers are those obtained by the heat treatment at 200°–400° C. in an oxidizing atmosphere of precursors selected from the group consisting of polyacrylonitrile fibers, cellulosic fibers and polyvinyl alcohol fibers.

3. A process as claimed in claim 1 wherein the carbonized fibers are those obtained by the carbonization of thermally stabilized fibers at 800°–1500° C. in a non-oxidizing atmosphere.

4. A process as claimed in claim 1 wherein said chemical substance or alkyl derivative is selected from those which generate a residue less than 5% by weight under the action of heat at 240° C. for one hour.

5. A process as claimed in claim 1 wherein said chemical substance or alkyl derivative is selected from those which have a viscosity at normal temperature of not less than 50 centipoises, preferably no less than 100 centipoises and which are in the form of liquid or waxy solid.

* * * * *

UNITED STATES PATENT AND TRADEMARK OFFICE

CERTIFICATE OF CORRECTION

PATENT NO. : 4,284,615

DATED : August 18, 1981

INVENTOR(S) : Kunio Maruyama

It is certified that error appears in the above—identified patent and that said Letters Patent is hereby corrected as shown below:

First Title Page, Column 1 in the line entitled

"[73] Assignees:" please change

"Japan Exlan Company, Ltd.;
Sumitomo Chemical Company
Limited, both of Osaka, Japan"

to

-- Sumitomo Chemical Company Limited, of

Osaka, Japan --.

Signed and Sealed this

*Twelfth* Day of *October 1982*,

[SEAL]

*Attest:*

GERALD J. MOSSINGHOFF

*Attesting Officer*

*Commissioner of Patents and Trademarks*